United States Patent [19]

Hogan

[11] 4,231,725

[45] Nov. 4, 1980

[54] PERISTALTIC PUMP

[75] Inventor: Lawrence R. Hogan, Lake Villa, Ill.

[73] Assignee: Cole-Parmer Instrument Company, Chicago, Ill.

[21] Appl. No.: 951,618

[22] Filed: Oct. 16, 1978

[51] Int. Cl.[3] ..... F04B 43/08; F04B 43/12

[52] U.S. Cl. ..... 417/477

[58] Field of Search ..... 412/477, 475, 476, 63

[56] References Cited

U.S. PATENT DOCUMENTS

| | | | |
|---|---|---|---|
| 3,366,071 | 1/1968 | Dutler | 417/477 |
| 3,740,173 | 6/1973 | Natelson | 417/477 |
| 3,791,777 | 2/1974 | Papoff | 417/477 X |
| 3,927,955 | 12/1975 | Spinosa et al. | 417/477 |
| 4,095,923 | 6/1978 | Cullis | 417/477 X |
| 4,138,205 | 2/1979 | Wallach | 417/477 X |

*Primary Examiner*—Richard E. Gluck

*Attorney, Agent, or Firm*—Fitch, Even, Tabin, Flannery & Welsh

[57] ABSTRACT

A peristaltic pump is disclosed which includes a base plate having a pair of reaction members pivotally mounted thereon for movement between open positions spaced outwardly from a rotor about which a compressible flow tube is disposed and closed positions maintaining the flow tube in predetermined relation to the rotor. Each reaction member has a shield plate thereon adapted for cooperation with the shield plate on the other reaction member so as to substantially cover the rotor area when the reaction members are in their closed positions. A locking nut mounted on the base plate is adapted for camming cooperation with the reaction members to draw them into predetermined closed relation relative to the tube and rotor.

16 Claims, 5 Drawing Figures

PERISTALTIC PUMP

The present invention relates generally to peristaltic type pumps, and more particularly to a peristaltic pump having novel reaction members which carry shield plates thereon mutually cooperable to shield a rotor and associated compressible flow tube during pump operation, the reaction members further being cooperable with a camming lock nut adapted to cam the reaction members into predetermined closed positions.

Peristaltic pumps of the type employing a rotatable rotor having one or more compression surfaces thereon operative to effect a peristaltic action on a compressible flow tube maintained in predetermined relation to the rotor are generally known. Peristaltic pumps have been found to be particularly effective in systems for dispensing condiments and the like, and find particular application in what is generally termed the "fast food" industry. In retail food outlets emphasizing quick service, devices which are capable of reducing the dispensing time for dispensing condiments onto salads, hamburger and hot dog type sandwiches, and other types of foods provide significant economic benefits which allow favorable pricing to attract customers over conventional restaurant service establishments. Peristaltic pumps have proven to be particularly effective for this purpose by facilitating incremental dispersement in an efficient and economical manner both when operated by employees of an establishment and when operated by the customers themselves in self-service type food establishments. Peristaltic pumps also provide significant economic advantages over conventional piston type pump dispensers from a cost standpoint and are substantially more accurate in unit discharge and less cumbersome in use than ladle type serving.

As employed in the aforenoted food services industry, peristaltic pumps have been developed which permit quick loading or adjustment of a compressible flow tube relative to an associated pump rotor so that little "downtime" is required when replacing or adjusting the flow tube in a pump as it is worn by the peristaltic action of the pump rotor. It is highly desirable from a safety standpoint that the rotatable rotor be shielded at all times during operation of the pump so as to prevent accidents to employees as well as possible damage to the pump unit, either of which interrupts normal operation with attendant economic losses.

One of the primary objects of the present invention is to provide a peristaltic pump which facilitates quick loading of a compressible flow tube relative to an associated rotatable rotor, and which includes novel means for shielding the rotor area during operation of the pump.

A more particular object of the present invention is to provide a peristaltic pump which includes a base plate or housing on which is rotatably mounted a rotor having a plurality of compression surfaces, and having a pair of reaction members pivotally mounted on the base plate for movement between open and closed positions relative to the rotor to facilitate loading and proper positioning of a compressible flow tube for peristaltic action by the rotor, each reaction member having a shield plate thereon cooperable with the shield plate on the other reaction member so as to shield the rotor area at all times during operation of the pump.

A feature of the present invention lies in the provision of reaction members and associated shield plates which are symmetrical relative to the longitudinal axis of the pump, and including a lock nut mounted on the base plate and adapted for camming cooperation with the reaction members to move them to predetermined closed positions relative to the rotor.

A further feature of the peristaltic pump of the present invention lies in the provision of a clamping bar cooperable with the base plate and defining therewith pairs of different size tube clamping surfaces adapted to accommodate tubes of different diameter for use with the pump.

Further objects and advantages of the present invention, together with the organization and manner of operation thereof, will become apparent from the following description when taken in conjunction with the accompanying drawing wherein like reference numerals designate like elements throughout the several views, and wherein.

Figure 1:
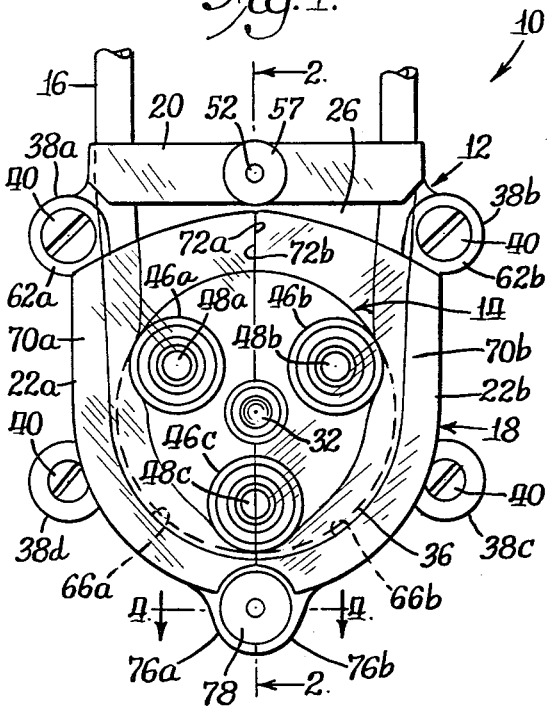
FIG. 1 is a front elevational view of a peristaltic pump constructed in accordance with the present invention.
Figure 2:
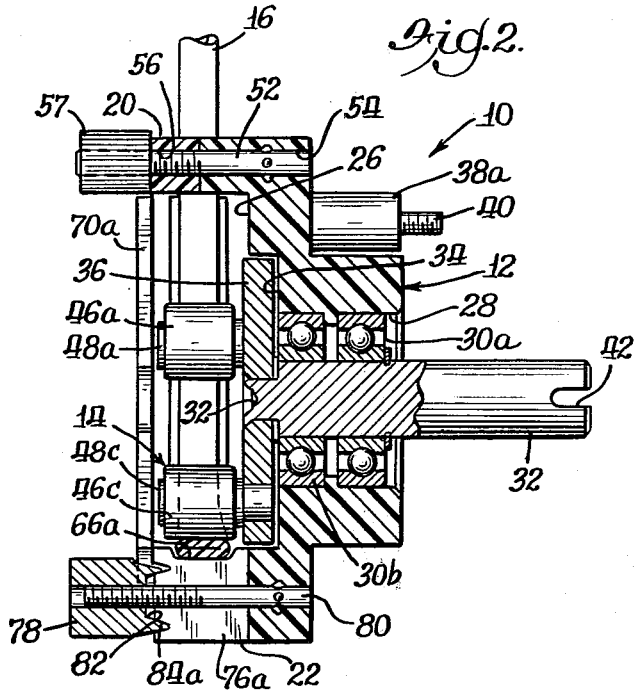
FIG. 2 is a longitudinal sectional view taken substantially along line 2—2 of FIG. 1.
Figure 3:
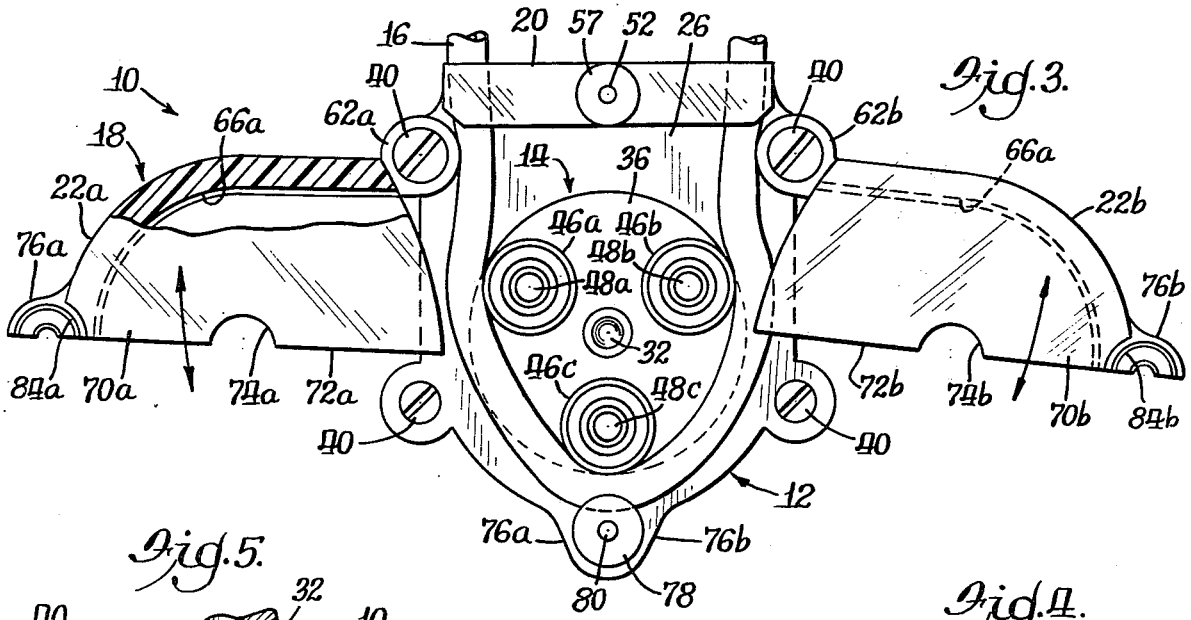
FIG. 3 is a front elevational view similar to FIG. 1 but showing the reaction members in their outward open positions facilitating loading of a compressible flow tube about the rotor, one of the reaction members having its associated shield plate partially broken away for clarity.

Referring now to the drawings, and particularly to FIGS. 1-3, a peristaltic pump constructed in accordance with the present invention is indicated generally at 10. Very generally, the peristaltic pump 10 includes a base plate or housing 12 which rotatably supports rotor means 14 adapted for cooperation with a compressible resilient flow tube or conduit 16. The flow tube 16, which may comprise a portion of a relatively long length of compressible tube or may comprise a relatively short length of tube having fittings on its opposite ends for connection in a fluid handling system, is maintained in operative relation to the rotor means 14 by reaction member means, indicated generally at 18, so that rotation of the rotor means 14 effects a peristaltic action on the flow tube. The flow tube 16 is maintained in relatively fixed axial relation to the base plate 12 and rotor means 14 by clamping bar means 20 having cooperative relation with the base plate as will be described more fully hereinbelow.

The reaction member means 18 includes a pair of reaction members **22*a* and 22*b* which may be termed reaction arms and which are symmetrical about a vertical median plane containing the longitudinal axis of the pump, as defined by the axis of rotation of the rotor means 14, when the pump is disposed in a position as shown in FIG. 1. The reaction members 22*a* and 22*b* are movable between first closed positions operative to position the flow tube 16 in predetermined relation to the rotor means 14 so as to effect a peristaltic pumping action on the tube during operation of the pump, and second open positions, as illustrated in FIG. 3, wherein the reaction members are spaced outwardly from the rotor to facilitate access to the tube and rotor for loading, replacement or servicing of the flow tube or rotor. In accordance with one feature of the present invention, to be described in greater detail hereinbelow, the reaction members 22***a, b* are releasably retained in their closed positions by a locking nut 24 mounted on the base plate 12 and adapted for camming cooperation with the reaction members so as to urge the reaction members to predetermined closed positions and maintain the reaction members in their closed positions until released to facilitate servicing of the flow tube or associated rotor.

Turning now to a more detailed description of the peristaltic pump 10, the base plate 12 is preferably made of a suitable plastic material and has a planar surface 26 formed thereon which lies in a plane normal to the axis of a bore 28 formed in the base plate and defining the axis of the base plate. The bore 28 is adapted to receive and support a pair of antifriction bearings 30*a* and 30*b* which rotatably support a drive shaft 32 of the rotor means 14. The base plate is counterbored at 34 to receive a circular rotor plate 36 which is suitably fixedly mounted on the inner end of the drive shaft 32 as by staking, welding or other suitable means.

The base plate 12 has a plurality of mounting bosses 38*a, b, c,* and *d* formed thereon which facilitate mounting of the pump 10 on a drive motor and associated mounting support such as indicated by reference numerals 14 and 16 in my copending application Ser. No. 828,482 filed Aug. 29, 1977. To this end, the mounting bosses 38*a–d* have axial bores therethrough adapted to receive mounting screws 40 to facilitate connection to a mounting support and associated drive motor. The drive shaft 32 extends rearwardly from the base plate 12 and associated mounting bosses 38*a–d* and is provided with a transverse drive slot 42 to facilitate coupling to a drive motor.

The rotor means 14 has a plurality of compression surfaces in the form of three cylindrical rollers 46*a,* 46*b,* and 46*c* mounted on the rotor plate 36 in equidistantly circumferentially spaced relation on a common diameter so as to extend outwardly or forwardly from the rotor plate in cantilevered normal relation thereto. The rollers 46*a–c* are each rotatably mounted on a support pin or dowel 48*a–c,* respectively, through a suitable bearing so as to be freely rotatable. The support dowels 48*a–c* are suitably secured in normal relation to the rotor plate 36.

As thus described, the cylindrical rollers 46*a–c* define compression surfaces which are moved through predetermined circular paths upon rotation of the rotor plate 36. The flow tube 16 is made of a compressible material suitable for repeated compression by the rollers 46*a–c* without losing its memory characteristics or otherwise undergoing premature fatigue failure. With the reaction members 22*a, b* disposed in their outward positions spaced from the rotor means 14, the flow tube 16 is looped about the rollers 46*a–c* and is retained in relatively fixed longitudinal relation to the rotor by the clamping bar 20.

Figure 5:
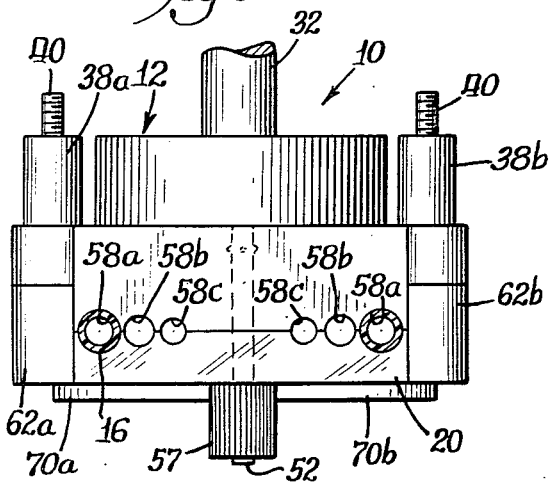
FIG. 5 is a fragmentary plan view of the pump illustrated in FIG. 1.

As best seen in FIGS. 2 and 5, the clamping bar 20 is mounted on the base plate 12 through a mounting stud 52 fixed within a suitable bore 54 in the base plate and received through a central bore 56 in the clamping bar. A nut 57 has threaded engagement with the outer end of the stud 52 and is manually tightenable against the clamping bar to maintain it in abutting relation against a generally rectangular portion 12*a* of the base plate 12 raised from the planar surface 26. The clamping bar 20 and base plate portion 12*a* cooperate to define pairs of different diameter flow tube clamping surfaces 58*a, b* and *c*. In the illustrated embodiment, the laterally outermost clamping surfaces 58*a* are sized to receive the upwardly extending ends of the flow tube 16 therein and maintain the tube in fixed relation to the rotor when the clamping bar 20 is held against the base plate 12 by nut 57 so as to prevent longitudinal movement or "snaking" of the tube when subjected to the peristaltic action of the rotor. The clamping surfaces 58*b* and 58*c* are adapted to receive and clamp smaller diameter compressible tubes about the rotor so as to prevent axial movement of the tube, it being understood that the various diameter tubes have substantially the same wall thickness.

As aforenoted, the reaction members 22*a, b* are symmetrical and are pivotally mounted on the base plate 12 for pivotal movement between their open and closed positions. Each reaction member 22*a, b* has a mounting boss 62*a, b,* respectively, formed integral therewith adapted to be pivotally mounted on the base plate through a mounting screw 40 received through a corresponding one of the mounting bosses 38*a, b,* respectively. Each reaction member 22*a, b* has a generally arcuate shaped reaction surface or channel 66*a, b,* respectively, formed thereon configured to engage the portion of the flow tube 16 disposed about the rotor 14 and establish a predetermined relationship between the flow tube and the rollers 46*a–c* when the reaction members are in their closed positions so that rotation of the rotor effects a peristaltic pumping action on the flow tube.

In accordance with an important feature of the present invention, each of the reaction members 22*a, b* has a shield plate 70*a, b,* respectively, formed thereon cooperable with the other shield plate so as to substantially totally cover or overlie the rotor area when the reaction members are in their closed positions. The reaction members 22*a, b* and associated shield plates 70*a, b* are preferably made of a suitable plastic material, with at least the shield plate portions being transparent to facilitate visual observation of the tube 16 and associated rotor means 14 during operation of the pump. Such visual observation is desirable to permit the operator to detect tube wear or other conditions of the hose and associated rotor elements during operation of the pump.

The shield plates 70*a, b* have mutually cooperable edge surfaces 72*a, b,* respectively, which are adapted for abutting relation when the reaction members are in their closed positions. The mutually cooperable edge surfaces 72*a, b* preferably have semicircular recesses 74*a, b* formed thereon so that when the shield plates are in closed positions, a circular opening is formed through the shield plates in axial alignment with the axis of rotation of the rotor drive shaft 32, as best seen in FIG. 1. The opening defined by the recess surfaces 74*a, b* permits insertion of a tachometer to monitor the rotational speed of the rotor 14 while preventing insertion of a finger into the rotor area.

Figure 4:
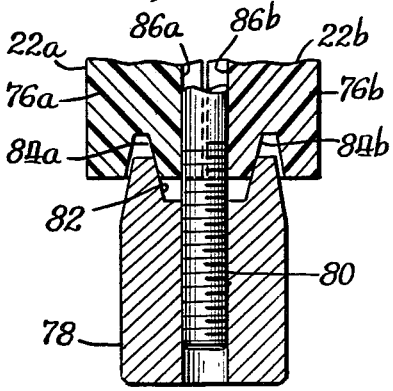
FIG. 4 is an enlarged fragmentary sectional view illustrating the cam locking nut as taken substantially along line 4—4 of FIG. 1, looking in the direction of the arrows.

The reaction members 22*a, b* have lower end portions 76*a, b,* respectively, which are adapted for cooperation with a cam lock nut 78 mounted on the base plate 12 so as to cam the reaction members to their closed positions. The lock nut 78 is threadedly mounted on a stub shaft 80 suitably mounted on the base plate 12, as best seen in FIGS. 2 and 4. The lock nut 78 has an internal frustoconical cam surface 82 formed thereon adapted for cooperation with similarly configured cam surfaces 84*a* and 84*b* formed on the lower end portions 76*a* and 76*b*, respectively, of the reaction members 22*a, b*, when the reaction members are disposed in closely spaced relation. By threading or tightening the cam lock nut 78 toward the reaction members when positioned in closely spaced relation, as shown in FIG. 4, such as when the reaction members are manually closed against the compressible tube 16, the cam surface 82 will engage the surfaces 84*a, b* on the reaction members and cam the reaction members to their fully closed positions with the edge surfaces 72*a, b* in abutting relation. To facilitate the cammed closing action, the lower ends 76*a, b* of the reaction members have semi-cylindrical recesses 86*a, b*, respectively, formed therein which establish a bore to receive the stub shaft 80 therethrough when the reaction members are in their closed positions.

Thus, in accordance with the present invention, a peristaltic pump is provided which facilitates quick loading of flow tubes of different diameter relative to a rotor internally of the pump and wherein safety shield plates are formed on the reaction members to substantially cover the rotor area and prevent insertion of fingers or other objects into the rotor area during operation of the pump. The cam lock nut 78 cooperates with the reaction members when they are brought into closely spaced relation so as to cam the reaction members to predetermined closed positions and maintain the reaction members in such closed positions.

While a preferred embodiment of the present invention has been illustrated and described, it will be understood to those skilled in the art that changes and modifications may be made therein without departing from the invention in its broader aspects. Various features of the invention are defined in the following claims.

What is claimed is:

1. In a peristaltic pump which includes a base plate, a rotor rotatably supported on the base plate and having at least two compression surfaces rotatable therewith through a predetermined path, and a pair of reaction members pivotably mounted on said base plate for movement relative to said base plate between open positions spaced from said rotor to facilitate loading and removal of a compressible fluid flow tube relative to said rotor, and closed positions operative to maintain the flow tube in position so that said compression surfaces effect a peristaltic pumping action on said tube during rotation of said rotor; the improvement wherein each of said reaction members includes a shield plate cooperable with the shield plate on the other of said reaction members so as to substantially cover said rotor when said reaction members are in their said closed positions, and means operatively associated with said base plate and selectively cooperable with said reaction members to maintain said reaction members in their said closed positions.

2. The improvement as defined in claim 1 wherein said shield plates are formed integral with said reaction members.

3. The improvement as defined in claim 1 wherein said reaction members and said shield plates are symmetrical about a median plane intersecting the longitudinal axis of said rotor.

4. The improvement as defined in claim 1 wherein said shield plates are transparent to facilitate visual observation of said rotor and associated compressible flow tube.

5. The improvement as defined in claim 1 wherein said means operative to maintain said reaction members in their said closed positions includes cam means mounted on said base plate and cooperative with said reaction members to bias said reaction members to their said closed positions.

6. The improvement as defined in claim 5 wherein said reaction members have locating surfaces thereupon adapted for mutually abutting relation when said reaction members are in their said closed positions, said cam means including a cam locking nut mounted on said base plate and movable into cooperating relation with said reaction members so as to cam said reaction members toward their said closed positions with said locating surfaces in abutting relation.

7. The improvement as defined in claim 6 wherein said reaction members have camming surfaces formed thereon, said cam locking nut having a camming surface thereon mutually cooperable with said camming surfaces on said reaction members so as to cam said reaction members toward their said closed positions upon selective movement of said locking nut.

8. The improvement as defined in claim 1 including means mounted on said base plate for maintaining a compressible flow tube in predetermined longitudinal relation to said rotor whereby to facilitate movement of said reaction members between their said open and closed positions without effecting substantial movement of said tube.

9. The improvement as defined in claim 7 wherein said camming surfaces formed on said reaction members cooperate to define an annular cam surface when said reaction members are disposed in their said closed positions, said cam locking nut having an annular camming surface thereon cooperable with said annular cam surface defined by said reaction members so as to cam said reaction members toward their said closed positions upon selective rotation of said locking nut.

10. The improvement as defined in claim 9 wherein said camming surfaces comprise frustoconical camming surfaces.

11. The improvement as defined in claim 1 including clamping bar means cooperable with said base plate and adapted for clamping cooperation with a flow tube when disposed about said rotor so as to prevent axial movement of the tube.

12. The improvement as defined in claim 11 wherein said clamping bar means comprises a clamping bar adjustably mounted on said base plate and defining therewith a plurality of different size clamping surfaces adapted for clamping relation with flow tubes of predetermined different diameter.

13. The improvement as defined in claim 11 wherein said clamping bar means is releasably mounted on said base plate, and including a locking nut cooperable with said clamping bar means and adapted to releasably maintain said clamping bar means in fixed clamping relation with said base plate.

14. The improvement as defined in claim 13 wherein said clamping bar means and said base plate define mutually cooperable semi-cylindrical clamping surfaces adapted for clamping relation with flow tubes of different diameter.

15. In a peristaltic pump which includes a base plate, a rotor rotatably supported on the base plate and having at least two compression surfaces rotatable therewith through a predetermined path, and a pair of reaction members pivotably mounted on said base plate for movement relative to said base plate between open positions spaced from said rotor to facilitate loading and removal of a compressible fluid flow tube relative to said rotor, and closed positions operative to maintain the flow tube in position so that said compression surfaces effect a peristaltic pumping action on said tube during rotation of said rotor; the improvement wherein said reaction members define mutually cooperable cam surfaces thereon, and including a cam locking nut mounted on said base plate for selective adjustment relative to said reaction members, said cam locking nut being simultaneously cooperable with said cam surfaces on said reaction members and operable to bias said reaction members toward their said closed positions.

16. The improvement as defined in claim 15 wherein said reaction members define a substantially frustoconical cam surface when in their said closed positions, said cam locking nut defining a frustoconical cam surface thereon selectively cooperable with said cam surface defined by said reaction members to bias said reaction members to their said closed positions.

* * * * *